US006234153B1

(12) United States Patent
DeGroot et al.

(10) Patent No.: US 6,234,153 B1
(45) Date of Patent: May 22, 2001

(54) PURGE ASSISTED FUEL INJECTION

(75) Inventors: Kenneth P. DeGroot, Macomb Township; Bruce H. Teague, Grosse Pointe Park; Michael J. Reale; Raymond J. Sullivan, both of Royal Oak; Dennis A. Soltis, Lake Orion; Mark J. Duty, Davison, all of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/416,167

(22) Filed: Oct. 11, 1999

(51) Int. Cl.[7] ..... F02M 21/02
(52) U.S. Cl. ..... 123/525; 123/531; 123/520
(58) Field of Search ..... 123/357, 516, 123/525, 519, 520, 521, 518, 531

(56) References Cited

U.S. PATENT DOCUMENTS

| | | | | |
|---|---|---|---|---|
| 4,245,592 | | 1/1981 | Atkins, Sr. . | |
| 4,368,714 | * | 1/1983 | Emmenthal | 123/531 |
| 4,703,736 | | 11/1987 | Atkins, Sr. . | |
| 4,754,740 | * | 7/1988 | Emmenthal | 123/531 |
| 4,821,701 | | 4/1989 | Nankee, II et al. . | |
| 4,961,412 | * | 10/1990 | Furuyama | 123/357 |
| 5,002,596 | | 3/1991 | Moskaitis et al. . | |
| 5,005,550 | | 4/1991 | Bugin, Jr. et al. . | |
| 5,024,687 | | 6/1991 | Waller . | |
| 5,263,460 | | 11/1993 | Baxter et al. . | |
| 5,275,145 | * | 1/1994 | Tuckey | 123/525 |
| 5,315,973 | * | 5/1994 | Hill | 123/525 |
| 5,349,934 | * | 9/1994 | Miyano | 123/525 |
| 5,479,906 | * | 1/1996 | Collie | 123/525 |
| 5,495,749 | | 3/1996 | Dawson et al. . | |
| 5,623,907 | * | 4/1997 | Cotton | 123/525 |
| 5,634,868 | | 6/1997 | Weber et al. . | |
| 5,641,899 | | 6/1997 | Blomquist et al. . | |
| 5,651,349 | | 7/1997 | Dykstra et al. . | |
| 5,682,869 | | 11/1997 | Nankee, II et al. . | |
| 5,809,969 | | 9/1998 | Fiaschetti et al. . | |
| 5,979,419 | * | 11/1999 | Toyoda | 123/357 |

* cited by examiner

*Primary Examiner*—Carl S. Miller
(74) *Attorney, Agent, or Firm*—Donna L. Berry

(57) ABSTRACT

A fuel control system is provided including a fuel tank, a purge vapor canister, a vapor line, and a fuel injector connected to an internal combustion engine. A purge vapor canister vent valve seals the purge vapor canister from the atmosphere such that the fuel tank, purge vapor canister, and fuel injector form a closed system. Upon initial starting of the engine, the purge vapor pressure is such that the purge vapor is drawn to the fuel injector from the dome portion of the fuel tank after passing through the purge vapor canister. Simultaneously therewith, the amount of liquid fuel is reducing or increasing by an amount of equally increasing or decreasing, respectively, vapor fuel so that a necessary mass flow rate is achieved to support combustion. As the amount of fuel vapors decreases to a negligible amount, combustion is supported by the atomization of liquid fuel. The delivery of the liquid fuel and vapor fuel is completed through the use of a fuel injector to accommodate both liquid and vapor form of fuel.

14 Claims, 2 Drawing Sheets

PURGE ASSISTED FUEL INJECTION

BACKGROUND OF THE INVENTION

1. Technical Field

The present invention generally relates to fuel control systems for fuel-injected vehicles and, more particularly, to a fuel injector system using fuel vapors from the fuel tank to power an internal combustion engine during start-up and steady-state operation.

2. Discussion

Modern automotive vehicle engines commonly employ injected fuel for combustion. At start-up, when the engine is not fully warm, the injected fuel is commonly cold. Cold fuel is harder to vaporize than warm fuel. As such, some of the fuel remains in a liquid state when injected. The injected liquid fuel tends to lead to decreased combustibility at start-up. This may result in undesirable emission levels.

To improve emission levels, different techniques have been employed before and after combustion. One pre-combustion treatment has been to heat the fuel prior to its injection. By heating the fuel, it becomes more easily vaporized thereby improving its combustibility. While successful, such pre-combustion heating is complex and expensive to implement. A common post-combustion treatment involves the employment of a catalyst in the engine exhaust gas stream. The catalyst burns the undesirable exhaust gas constituents prior to their passage to the atmosphere. While also successful, such post-combustion burning is also expensive and complex to implement.

Modern automotive vehicles are commonly equipped with a fuel vapor purge control system. Such a system accommodates fuel within the fuel tank which tends to vaporize as temperatures increase. The vaporized fuel collects in the fuel tank and is periodically removed by the purge vapor control system. The fuel vapors from the tank are initially collected and stored in a vapor canister. When the engine operating conditions are conducive to purging, a purge valve is opened permitting the engine to draw the fuel vapors from the purge canister for combustion.

Even with such a purge fuel vapor control system installed, some fuel vapor is commonly present in the dome portion of the fuel tank at start-up. Advantageously, it has now been discovered that these fuel vapors can be supplied to the engine at start-up via the fuel injectors. This allows the engine to utile fuel vapors in place of some portion of the cold liquid fuel at start-up. Moreover, the fuel vapors can continue to be injected during the steady-state operation to take full advantage of the availability of the fuel vapor.

SUMMARY OF THE INVENTION

The present invention provides a purge assisted fuel injection system and a method of using the same. The system includes a fuel tank coupled to a purge vapor collection canister by a vapor line. The purge vapor collection canister is coupled to a fuel injector operatively associated with an internal combustion engine by a second vapor line. A purge vapor canister vent valve selectively seals the purge vapor canister from atmosphere such that the fuel tank, purge vapor canister, and fuel injectors form a closed system.

Upon engine start, a purge valve disposed between the purge vapor canister and the fuel injectors is opened such that the pressure differential between the fuel injectors and the remainder of the system causes fuel vapor collected within a dome portion of the fuel tank to be drawn through the purge vapor canister and toward the fuel injectors.

Simultaneously therewith, the amount of liquid fuel injected by the fuel injectors to the engine is reduced such that a desired amount of total fuel delivery is established. As the pressure differential between the fuel injectors and the remainder of the closed system changes over time, the flow rate of purge vapors from the fuel tank decreases. Commensurate therewith, the amount of injected liquid fuel is increased. During this time the engine is warming such that the increased amount of injected liquid fuel is more easily vaporized thereby yielding better combustibility. When the engine reaches a fully warm operating condition, the purge valve may be closed with complete fuel delivery being provided by the fuel injectors. Alternatively and desirably, purge vapors, if in adequate supply, may continue to fuel the engine through the fuel injectors during steady-state engine operations to make the most efficient use of the fuel vapors.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail though the use of the accompanying drawings in which.

DETAILED DESCRIPTION OF THE PREFERRED EMBODIMENT

The present invention is directed towards an apparatus and method for fueling an internal combustion engine during engine start up and steady state operation. More particularly, the present invention directs fuel vapor from the fuel tank to the fuel injectors during start up and during steady-state engine operation. A commensurate amount of injected liquid fuel is removed during this time so that the appropriate total amount of fuel is delivered to the engine. As the engine warms, fuel vapor from the fuel tank may continue to fuel the engine through the fuel injectors, or total fuel delivery may be satisfied by the liquid fuel system utilizing a fuel pump and a fuel line, through the same fuel injectors.

Figure 1:
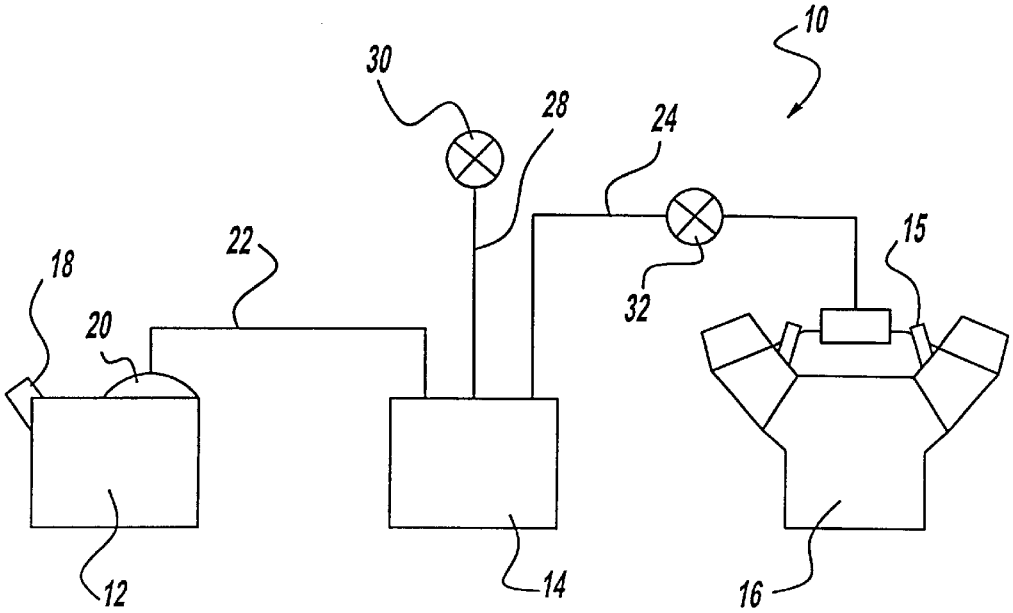
FIG. 1 is a schematic illustration of a purge vapor control system according to the present invention

Turning now to the drawing figures, a purge vapor control system according to the present invention is illustrated schematically at FIG. 1. The purge assisted fuel injection system 10 includes a fuel tank 12, a purge vapor collection canister 14, a purge assisted fuel injector 15, and an internal combustion engine 16. The fuel tank 12 includes a fuel fill tube 18 and a vapor dome 20. The fuel tank 12 is interconnected with the purge vapor collection canister 14 by a fuel tank vapor line 22. The fuel tank vapor line 22 is coupled to the dome portion 20 of the fuel tank 12. As is known, fuel vapors in the fuel tank 12 migrate through the tank vapor line 22 and are stored in the purge vapor collection canister 14.

The purge vapor collection canister 14 is interconnected with the purge assisted fuel injector 15 by a purge vapor line 24. The purge assisted fuel injector 15 is connected to the internal combustion engine 16. The fuel vapor canister 14 communicates with the atmosphere by way of a vent line 28 coupled thereto. A purge canister vent valve 30 is disposed along the purge canister vent line 28 to selectively seal the purge vapor collection canister 14 from the atmosphere. A purge valve 32 is disposed along the purge vapor line 24 for selectively isolating the purge vapor collection canister 14 and the fuel tank 12 from the purge assisted fuel injector 15.

During normal purging operations, the purge canister vent valve 30 is open thereby allowing the purge vapor collection canister 14 to communicate with the atmosphere. Also, the purge valve 32, which is typically closed during operation of the internal combustion engine 16, is opened when engine operations are conducive to purging, thereby allowing the higher pressure within the fuel tank 12 to force purge vapors from the purge vapor collection canister 14 through the purge vapor line 24 and into the purge assisted fuel injector 15 and ultimately into the internal combustion engine 16 for combustion.

At start-up, only a small amount of fuel vapors are present in the purge vapor collection canister 14. The majority of the fuel vapors reside in the vapor dome 20 of the fuel tank 12 at start up. By closing the purge canister vent valve 30 and opening the purge valve 32 at startup, the higher pressure in the fuel tank 12 relative to the manifold vacuum forces fuel vapors from the vapor dome 20 of the fuel tank 12 into the purge assisted fuel injector 15 and ultimately into the internal combustion engine 16. In addition to utilizing fuel vapors at startup, the fuel vapors may be utilized during the steady-state operation of the internal combustion engine 16 as long as fuel vapors are in adequate supply.

Figure 2:
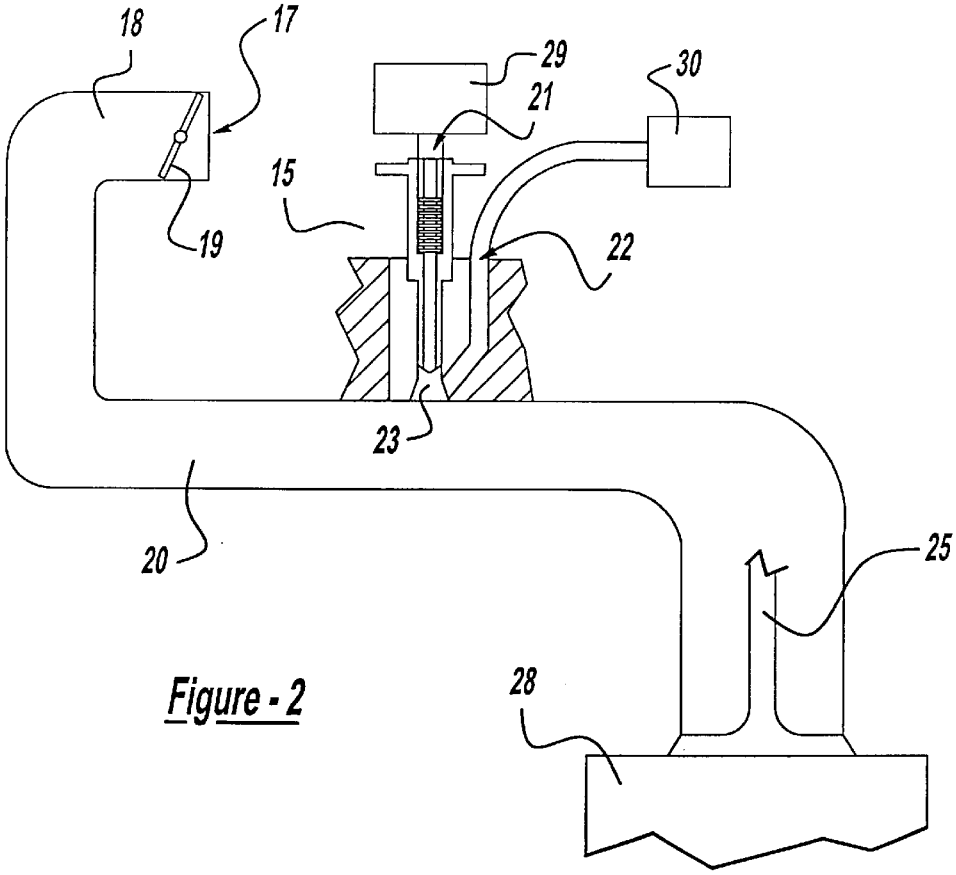
FIG. 2 is a more detailed view of the internal combustion engine intake system and fuel injector of FIG. 1.

Turning now to FIG. 2, a schematic illustration is provided of an internal combustion engine's intake system 16 as it relates to the present invention. The intake system includes an air intake 17 communicating with a plenum 18. A throttle valve 19 is disposed within the plenum 18 adjacent the air intake 17. A runner 20 extends from the plenum 18 and terminates at an engine intake valve 25. The intake valve 25 leads to a combustion cylinder 28. The purge assisted fuel injector 15 is disposed along the runner 20. The fuel injector 15 includes a liquid fuel inlet 21 coupled to a liquid fuel supply 29 and a vapor fuel inlet 22 coupled to a fuel vapor supply 30. The fuel vapor supply 30 preferably comprises the purge vapor line 24 of FIG. 1. The liquid fuel inlet 21 communicates with the vapor fuel inlet 22 at a fuel blending zone 23. A fuel outlet connects the fuel blend zone 23 and the runner 20.

During normal intake operations while the internal combustion engine 16 is operating, air enters the plenum 18 through an air intake inlet 17 which is governed by a throttle valve 19. Once air enters the runner 20 it is ready to be mixed with a corresponding amount of fuel supplied by the purge assisted fuel injector 15.

To supply an adequate amount of fuel to the runner 20, the purge assisted fuel injector 15 communicates with two separate fuel supply systems, the liquid fuel supply 29 and the vapor fuel supply 30. Liquid fuel is supplied to the purge assisted fuel injector 15 through a liquid fuel inlet 21. Vapor fuel is supported through a vapor fuel inlet 22. Vapor fuel may be supplied to the purge assisted fuel injector 15 for as long as vapor fuel is in supply during startup and steady-state operations.

After fuel enters both inlets 21 and 22 it moves through the purge assisted fuel injector 15 towards a fuel blending zone 23 where the liquid fuel is atomized and is blended with the vapor fuel supplied from the vapor fuel inlet 22. After blending, the fuel passes into the runner 20 and is mixed with the air before passing through an intake valve 25 and ultimately to engine combustion chamber 28.

Figure 3:
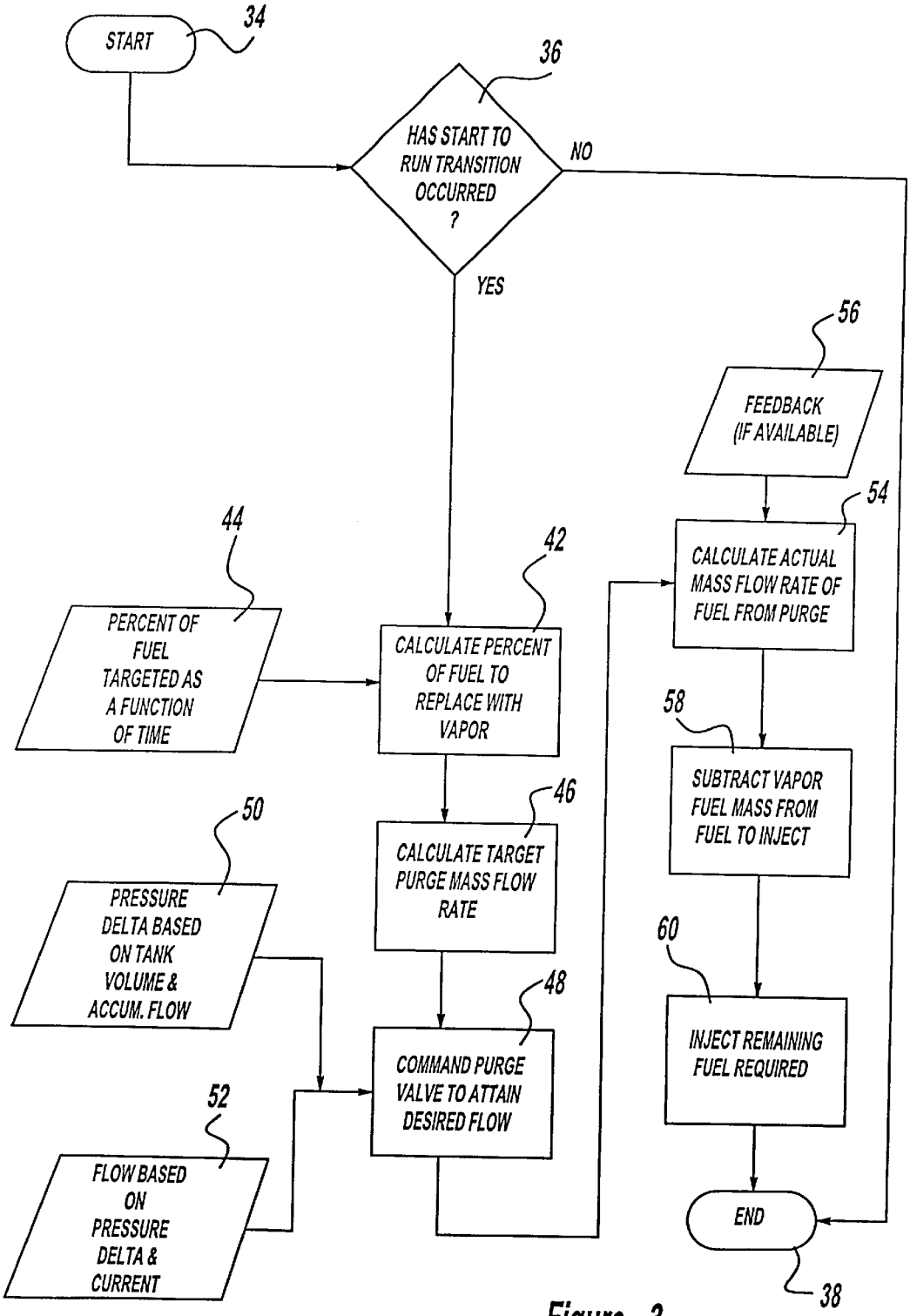
FIG. 3 is a flow chart depicting a control methodology for the purge vapor control system of FIG. 1.

Turning now to FIG. 3, a methodology for controlling the above-described purge assisted fuel injection system is illustrated. The methodology starts in bubble 34 and falls through to decision block 36. In decision block 36, the methodology determines whether the start-to-run transition of the internal combustion engine has occurred. If not, the methodology advances to bubble 38 and exits the routine pending a subsequent execution thereof. However, if the start-to-run transition has occurred at decision block 36, the methodology continues to decision block 42.

In decision block 42, the methodology calculates the percent of liquid injected fuel to replace with the fuel vapor from the fuel tank. Data block 44 dictates that the percent of fuel to be replaced is targeted as a function of time since start-up. The desired percentage of fuel vapor to be provided is preferably the maximum amount within certain limits. For instance, at idle, a minimum pulse width requirement for the liquid injected fuel sets the maximum vapor flow limit. The minimum pulse width sets the minimum amount of fuel that can be accurately delivered by the fuel injectors depending on the operating parameters of the engine. The fuel injectors are never completely turned off to avoid transient fuel concerns at a throttle tipin event. During off idle conditions, a maximum rate of flow from the fuel tank is the maximum limit. From block 42, the methodology continues to block 46.

In block 46, the methodology calculates the target purge fuel vapor mass flow rate. As described above, the target purge mass flow rate is that amount of fuel vapor required to replace the injected fuel calculated to be removed at block 42. From block 46, the methodology continues to block 48.

In block 48, the methodology commands the purge valve to open such that a desired amount of purge fuel vapor mass flow is attained. Over time, the pressure difference between the fuel injector(s) and the fuel tank changes. As such, the rate of flow between the fuel tank and the fuel injector(s) changes. Data block 50 dictates that the pressure change is based on tank volume and accumulated flow. Data block 52 dictates that the rate of flow change is based on the pressure change and the current rate of flow. Conveniently, the pressure change in data block 50 and the purge flow in data block 52 can be mapped in a pair of tables as a function of time. From block 48, the methodology continues to block 54.

In block 54, the methodology calculates the actual mass flow rate of the fuel from the purge system. Data block 56 provides feedback to this calculation if it is available. For instance, a fuel modifier from a dynamic crankshaft fuel control system could be input here to further vary the fueling strategy. A preferred fuel control system is fully described in U.S. Pat. No. 5,809,969 entitled Method of Processing Crankshaft Speed Fluctuations for Control Applications which is hereby incorporated by reference herein. After calculating the actual mass flow rate of the fuel from the purge system at block 54, the methodology continues to block 58. In block 58, the methodology subtracts the amount of vapor fuel mass calculated at block 54 from the amount of liquid fuel to inject. From block 58 the methodology continues to block 60.

In block 60, the methodology injects the amount of liquid fuel calculated at block 58. As can be appreciated, as the mass flow rate of fuel vapor from the fuel tank decreases, the amount of liquid fuel required to be injected at block 60 increases. When the mass flow rate of the purge fuel vapors drops below a minimum threshold, complete fuel delivery is supplied by the liquid fuel system. By this time, the engine should be warm thereby heating the injected liquid fuel such that it is effectively vaporized resulting in improved emissions. From block 60, the methodology continues to bubble 38 where it exits the routine pending a subsequent execution thereof.

Thus, a fuel control system is provided for fueling an internal combustion engine with fuel vapors from the fuel tank at start-up and during steady-state operation. In combination therewith, a reduced amount of liquid fuel is injected into the engine. As the engine warms up, the ratio of fuel vapor to injected liquid fuel may change such that engine operation may eventually transition to completely injected fuel depending upon fuel vapor supply. Advantageously, cold engine operation is supplemented by fuel vapors thereby reducing emissions which may accompany the combustion of cold liquid fuel.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. A purge assisted fuel injection system comprising:

a fuel tank;

a fuel tank vapor line coupled to said fuel tank;

a purge vapor collection canister coupled to said fuel tank vapor line;

a purge vapor line coupled to said purge vapor collection canister;

at least one fuel injector disposed in an intake and coupled to said purge vapor line;

a liquid fuel injection delivery device;

a liquid fuel line coupled to said liquid fuel injection delivery device and to said at least one fuel injector; and a blending zone attached to said intake between an outlet of said at least one fuel injector and an outlet of said purge vapor line where said fuel vapor from said purge vapor collection canister blends with liquid fuel from said liquid fuel injection delivery device.

2. The fuel injection system of claim 1 further comprising:

a valve disposed along said purge vapor line between said purge vapor canister and said fuel injector for controlling the flow of vaporous fuel to said engine.

3. The fueling system of claim 1 further comprising:

a purge canister vent line coupled to said purge vapor collection canister; and a purge canister vent valve disposed along said purge canister vent line for selectively isolating said purge vapor collection canister from atmosphere.

4. The fueling system of claim 1 wherein said at least one fuel injector further comprises a plurality of fuel injectors.

5. The fueling system of claim 4 wherein said plurality of fuel injectors further comprises one injector per combustion cylinder.

6. A fuel injector comprising:

a liquid inlet communicating with a liquid fuel supply;

a liquid outlet communicating with said liquid inlet for delivering liquid fuel from said liquid fuel supply;

a vapor inlet communicating with a purge vapor fuel supply;

a vapor outlet communicating with said vapor inlet for delivering vapor fuel from said purge vapor fuel supply; and a blending zone between said liquid outlet and said vapor outlet where said liquid fuel from said liquid fuel supply blends with said vapor fuel from said purge vapor fuel supply.

7. The fuel injector of claim 6 further comprising:

a purge vapor line coupled to said vapor inlet of said fuel injector and a fuel vapor purge canister.

8. The fuel injector of claim 7 further comprising:

a purge valve disposed along said purge vapor line for selectively permitting delivery of said fuel vapor from said fuel vapor purge canister to said fuel injector.

9. The fuel injector of claim 8 further comprising:

a fuel vapor canister vent line coupled to said purge vapor collection canister; and a purge canister vent valve disposed along said fuel vapor canister vent line.

10. The fuel injector of claim 9 further comprising:

a liquid fuel line connected to said liquid inlet and a fuel tank.

11. The fuel injector of claim 10 further comprising:

a fuel tank vapor line connected to a vapor dome of said fuel tank and to said purge vapor collection canister.

12. A method of fueling an internal combustion engine comprising:

determining a time since a start-up event;

determining an amount of liquid fuel to replace with purge vapor fuel according to said time since said start-up event;

calculating a target purge vapor mass flow rate required to replace said amount of liquid fuel with purge vapor fuel;

opening a purge valve by a pre-selected amount to deliver said target purge vapor mass flow rate of fuel vapors from a purge vapor control system to a fuel injector;

determining an actual purge vapor mass flow rate of said fuel vapors;

delivering a quantity of liquid fuel from a fuel injection system to said fuel injector corresponding to said actual purge vapor mass flow rate of said fuel vapors such that a desired total amount of fuel is delivered to said fuel injector;

injecting said fuel vapors and said liquid fuel into said internal combustion engine; and combusting said fuel vapors and liquid fuel.

13. The method of claim 12 wherein said preselected amount corresponds to a pressure delta based on a volume of a fuel tank storing said liquid fuel and an accumulated amount of purge vapor flow.

14. The method of claim 13 wherein said preselected amount corresponds to said pressure delta and a current purge vapor flow.

* * * * *